US010322785B2

(12) United States Patent
Saruwatari et al.

(10) Patent No.: US 10,322,785 B2
(45) Date of Patent: Jun. 18, 2019

(54) OUTBOARD MOTOR

(71) Applicant: YAMAHA HATSUDOKI KABUSHIKI KAISHA, Iwata-shi, Shizuoka (JP)

(72) Inventors: Kimitaka Saruwatari, Shizuoka (JP); Chiharu Masuda, Shizuoka (JP); Yutaka Nakanishi, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 15/795,361

(22) Filed: Oct. 27, 2017

(65) Prior Publication Data

US 2018/0251202 A1 Sep. 6, 2018

(30) Foreign Application Priority Data

Mar. 6, 2017 (JP) ..... 2017-041617

(51) Int. Cl.

| | |
|---|---|
| ***B63H 20/28*** | (2006.01) |
| ***F01M 5/00*** | (2006.01) |
| ***F01P 3/20*** | (2006.01) |
| ***F02B 61/04*** | (2006.01) |
| ***F01P 3/02*** | (2006.01) |
| ***F01P 7/16*** | (2006.01) |
| ***F01P 11/08*** | (2006.01) |

(52) U.S. Cl.

CPC ..... *B63H 20/28* (2013.01); *F01M 5/002* (2013.01); *F01P 3/02* (2013.01); *F01P 3/202* (2013.01); *F01P 7/16* (2013.01); *F01P 11/08* (2013.01); *F02B 61/045* (2013.01); *F01P 3/205* (2013.01); *F01P 2060/04* (2013.01)

(58) Field of Classification Search

CPC ..... B63H 20/28; F02B 61/045; F01M 5/002; F01P 3/202

USPC ..... 440/88 C, 88 N, 88 HE, 88 K

See application file for complete search history.

(56) References Cited

U.S. PATENT DOCUMENTS

| | | | | |
|---|---|---|---|---|
| 5,921,829 | A | 7/1999 | Iwata | |
| 6,418,887 | B1 * | 7/2002 | Okamoto | F01M 5/005 123/41.33 |
| 6,834,635 | B2 * | 12/2004 | Yomo | F01M 1/02 123/196 AB |
| 2011/0195620 | A1 * | 8/2011 | Davis | B63H 20/14 440/75 |
| 2013/0065462 | A1 | 3/2013 | Saruwatari et al. | |

FOREIGN PATENT DOCUMENTS

| | | |
|---|---|---|
| JP | 07-305631 A | 11/1995 |
| JP | 2000-120420 A | 4/2000 |

* cited by examiner

*Primary Examiner* — Anthony D Wiest

(74) *Attorney, Agent, or Firm* — Keating and Bennett, LLP

(57) ABSTRACT

An outboard motor includes an oil cooler, an engine cooling water passage, an oil cooling water passage, and a water discharge passage. The oil cooler is disposed forward of a crankshaft. The engine cooling water passage is disposed inside an engine. The oil cooling water passage is connected to the oil cooler and branches from the engine cooling water passage. The water discharge passage is connected to the oil cooler. The water discharge passage is disposed lower than the oil cooler and forward of a center axis of the crankshaft.

13 Claims, 8 Drawing Sheets

OUTBOARD MOTOR

CROSS REFERENCE TO RELATED APPLICATIONS

This application claims the benefit of priority to Japanese Patent Application No. 2017-041617 filed on Mar. 6, 2017. The entire contents of this application are hereby incorporated herein by reference.

BACKGROUND OF THE INVENTION

1. Field of the Invention

The present invention relates to outboard motors.

2. Description of the Related Art

There is a type of outboard motor including an oil cooler for cooling oil that circulates inside an engine. For example, Japan Laid-open Patent Application Publication No. 2000-120420 describes an outboard motor in which an oil cooler is disposed forward of a crankshaft of an engine. An oil cooler cooling pipe is connected to a lateral surface of the oil cooler, and is disposed to pass through a lateral side of the engine. Additionally, a water discharge pipe is connected to the front surface of the oil cooler. Cooling water is supplied to the oil cooler through the oil cooler cooling pipe, and is discharged from the oil cooler through the water discharge pipe.

In the above described outboard motor, the water discharge pipe is connected to the front surface of the oil cooler at a position above the bottom surface of the oil cooler, and horizontally extends from the oil cooler. Therefore, when the outboard motor is tilted up after deactivation of the engine, the performance of water discharge from the oil cooler degrades, such that the cooling water is likely to remain inside the oil cooler. This may result in freezing of the cooling water inside the oil cooler. When the engine is restarted under this condition, the flow rate of the cooling water reduces and thus cooling efficiency degrades. Thus, there has been room for improvement regarding a cooling system in the well-known outboard motor.

SUMMARY OF THE INVENTION

Preferred embodiments of the present invention provide outboard motors in which performance of water discharge from an oil cooler is enhanced when an engine is deactivated and the outboard motor is tilted up.

An outboard motor according to a preferred embodiment of the present invention includes an engine, a drive shaft, a propeller shaft, an oil cooler, an engine cooling water passage, an oil cooling water passage, and a water discharge passage. The engine includes a crankshaft. The drive shaft is connected to the crankshaft, and extends downwardly from the engine. The propeller shaft is connected to the drive shaft, and extends in a direction intersecting with the drive shaft. The oil cooler is disposed forward of the crankshaft. The engine cooling water passage is disposed inside the engine. The oil cooling water passage is connected to the oil cooler and branches from the engine cooling water passage. The water discharge passage is connected to the oil cooler. The water discharge passage is disposed lower than the oil cooler and forward of a center axis of the crankshaft.

In the outboard motors according to the present preferred embodiment, the water discharge passage is disposed lower than the oil cooler and forward of the center axis of the crankshaft. With this structure, water discharge from the oil cooler is enhanced when the engine is deactivated and the outboard motor is tilted up.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
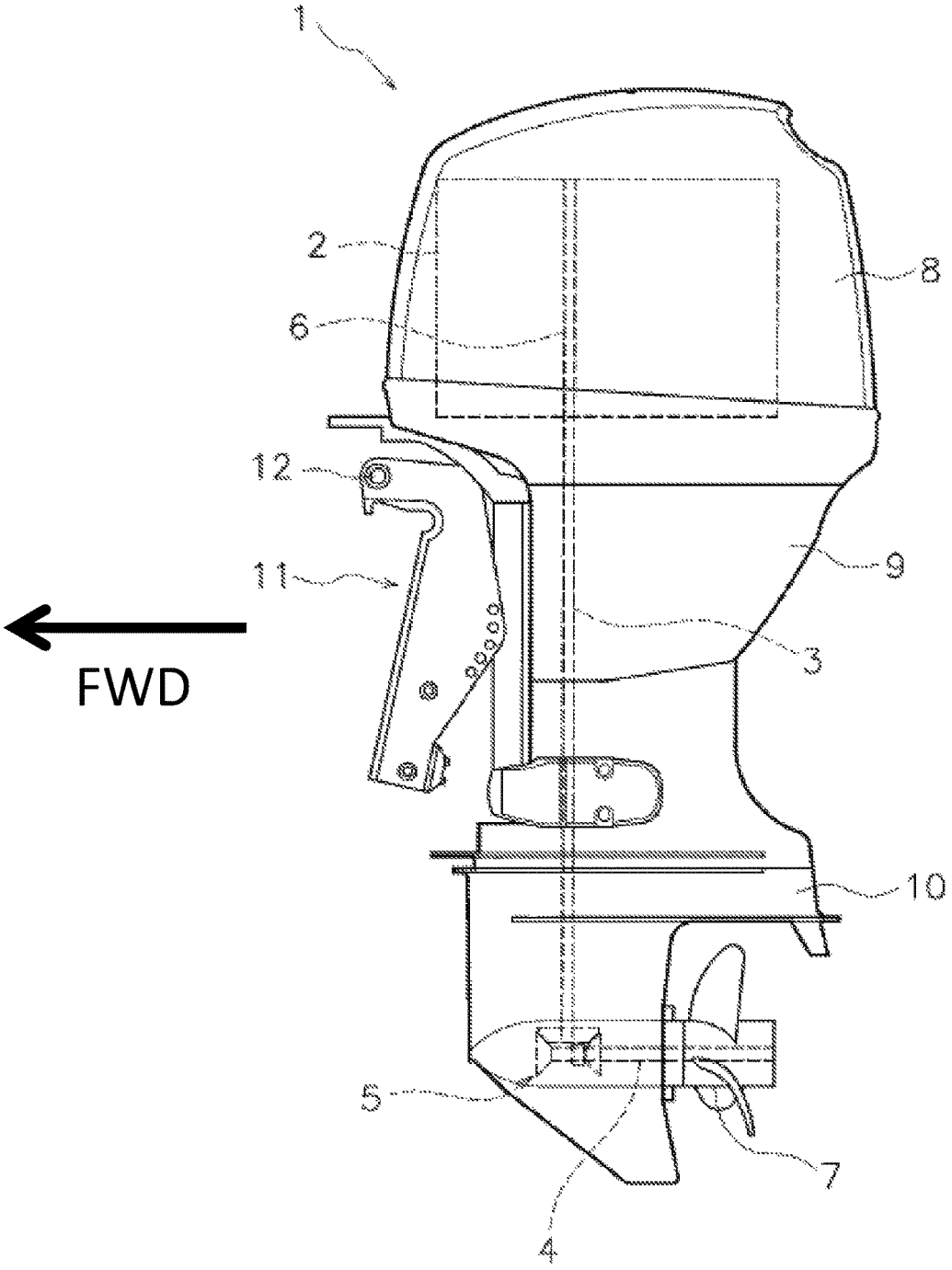
FIG. 1 is a side view of an outboard motor according to a preferred embodiment of the present invention.

Preferred embodiments of the present invention will be hereinafter explained with reference to drawings. FIG. 1 is a side view of an outboard motor 1 according to a preferred embodiment of the present invention. The outboard motor 1 includes an engine 2, a drive shaft 3, a propeller shaft 4, and a shift mechanism 5.

The engine 2 generates a thrust that propels a watercraft. The engine 2 includes a crankshaft 6. The crankshaft 6 extends in the vertical direction. The drive shaft 3 is connected to the crankshaft 6. The drive shaft 3 extends in the vertical direction. The drive shaft 3 extends downwardly from the engine 2.

The propeller shaft 4 extends in the back-and-forth direction. The propeller shaft 4 is connected to the drive shaft 3 through the shift mechanism 5. A propeller 7 is connected to the propeller shaft 4. The shift mechanism 5 switches a rotational direction of power to be transmitted from the drive shaft 3 to the propeller shaft 4. The shift mechanism 5 includes, for instance, a plurality of gears and a clutch that changes meshing of the gears.

The outboard motor 1 includes a cowl 8, an upper housing 9, and a lower housing 10. The cowl 8 accommodates the engine 2. The upper housing 9 is disposed below the cowl 8. The lower housing 10 is disposed below the upper housing 9. The upper housing 9 and the lower housing 10 accommodate the drive shaft 3. The lower housing 10 accommodates the propeller shaft 4.

The outboard motor 1 includes a bracket 11. The outboard motor 1 is attached to the watercraft through the bracket 11. The bracket 11 includes a trim and tilt shaft 12. The trim and tilt shaft 12 extends in the right-and-left direction. The bracket 11 supports the outboard motor 1 such that the outboard motor 1 is rotatable about the trim and tilt shaft 12.

Figure 2:
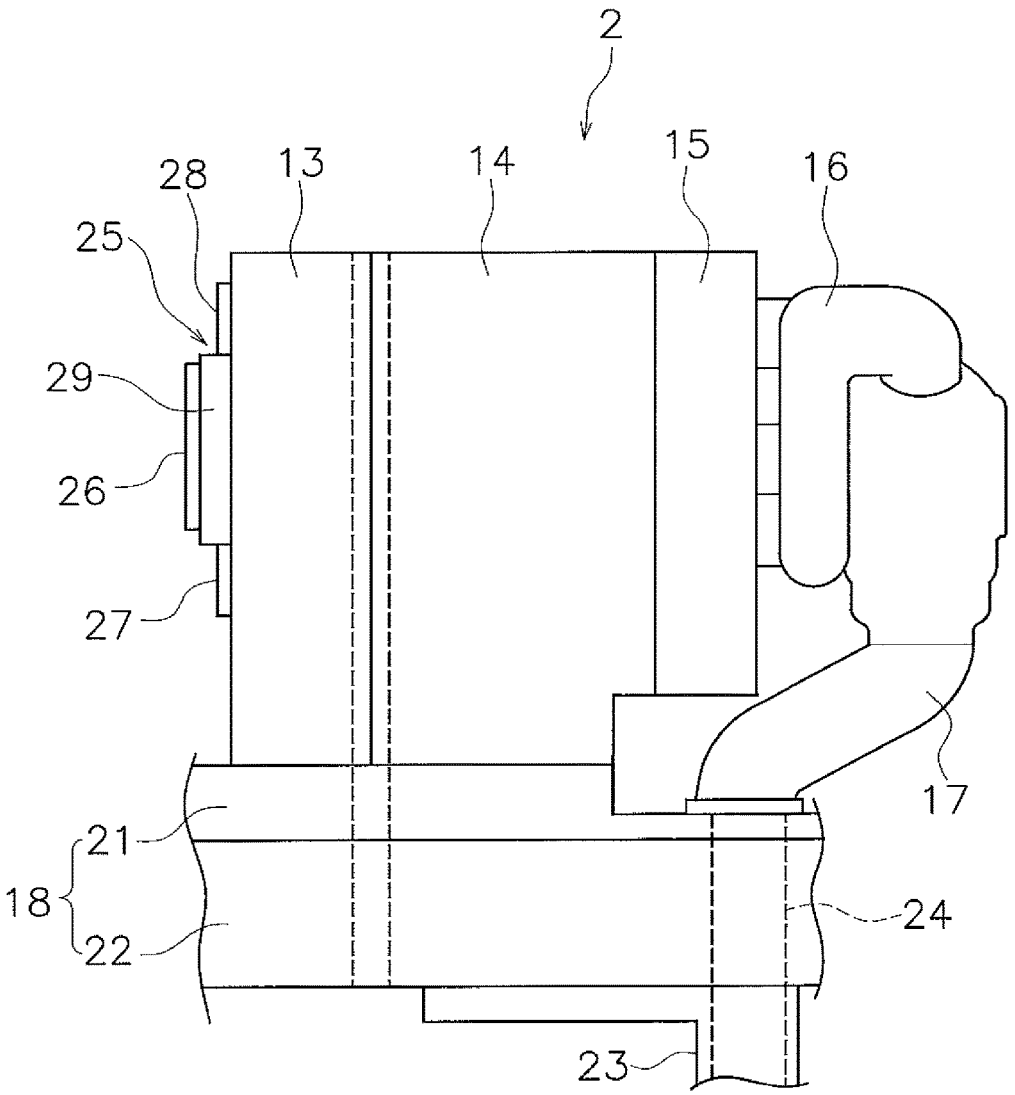
FIG. 2 is a side view of a schematic configuration of an engine.

FIG. 2 is a side view of a schematic configuration of the engine 2. As shown in FIG. 2, the engine 2 includes a crankcase 13, a cylinder body 14, and a cylinder head 15.

The cylinder body 14 is disposed behind the crankcase 13. The crankcase 13 and the cylinder body 14 accommodate the crankshaft 6. The cylinder head 15 is disposed behind the cylinder body 14.

The outboard motor 1 includes an exhaust manifold 16 and an exhaust pipe 17. The exhaust manifold 16 is connected to the cylinder head 15. The engine 2 is preferably a multi-cylinder engine, and the exhaust manifold 16 aggregates exhaust gas from a plurality of cylinders of the cylinder head 15. It should be noted that the engine 2 may be a single-cylinder engine. In this case, the exhaust manifold 16 may not be provided.

The exhaust pipe 17 is connected to the exhaust manifold 16. The exhaust pipe 17 is disposed behind the cylinder head 15. The exhaust pipe 17 extends downward.

The outboard motor 1 includes a support 18 and a muffler 23. The support 18 is disposed below the engine 2 and supports the engine 2. The support 18 includes an exhaust guide 21 and an oil pan 22. The engine 2 is disposed on the exhaust guide 21. The exhaust pipe 17 is connected to the exhaust guide 21. The oil pan 22 is disposed below the exhaust guide 21. The muffler 23 is disposed below the oil pan 22. An exhaust passage 24 is disposed in the exhaust guide 21, the oil pan 22, and the muffler 23. The exhaust passage 24 is connected to the exhaust pipe 17.

The outboard motor 1 includes a first oil cooler 25. The first oil cooler 25 is disposed in front of the engine 2. The first oil cooler 25 is attached to the front surface of the crankcase 13. The first oil cooler 25 is disposed forward of the crankshaft 6.

An electric component 26 is attached to the first oil cooler 25. The electric component 26 is, for instance, a rectifier/regulator. It should be noted that an electric component other than the rectifier/regulator may be attached to the first oil cooler 25. The first oil cooler 25 cools lubricating oil that circulates inside the engine 2. Additionally, the first oil cooler 25 cools the electric component 26.

The first oil cooler 25 includes a first cooler portion 27, a second cooler portion 28, and a third cooler portion 29. The first cooler portion 27, the third cooler portion 29, and the second cooler portion 28 are aligned in the up-and-down direction. The second cooler portion 28 and the third cooler portion 29 are disposed above the first cooler portion 27. The third cooler portion 29 is disposed between the first cooler portion 27 and the second cooler portion 28. In a front view, the area of the third cooler portion 29 is the largest among the areas of the first to third cooler portions 27 to 29. The electric component 26 is connected to the third cooler portion 29.

Figure 3:
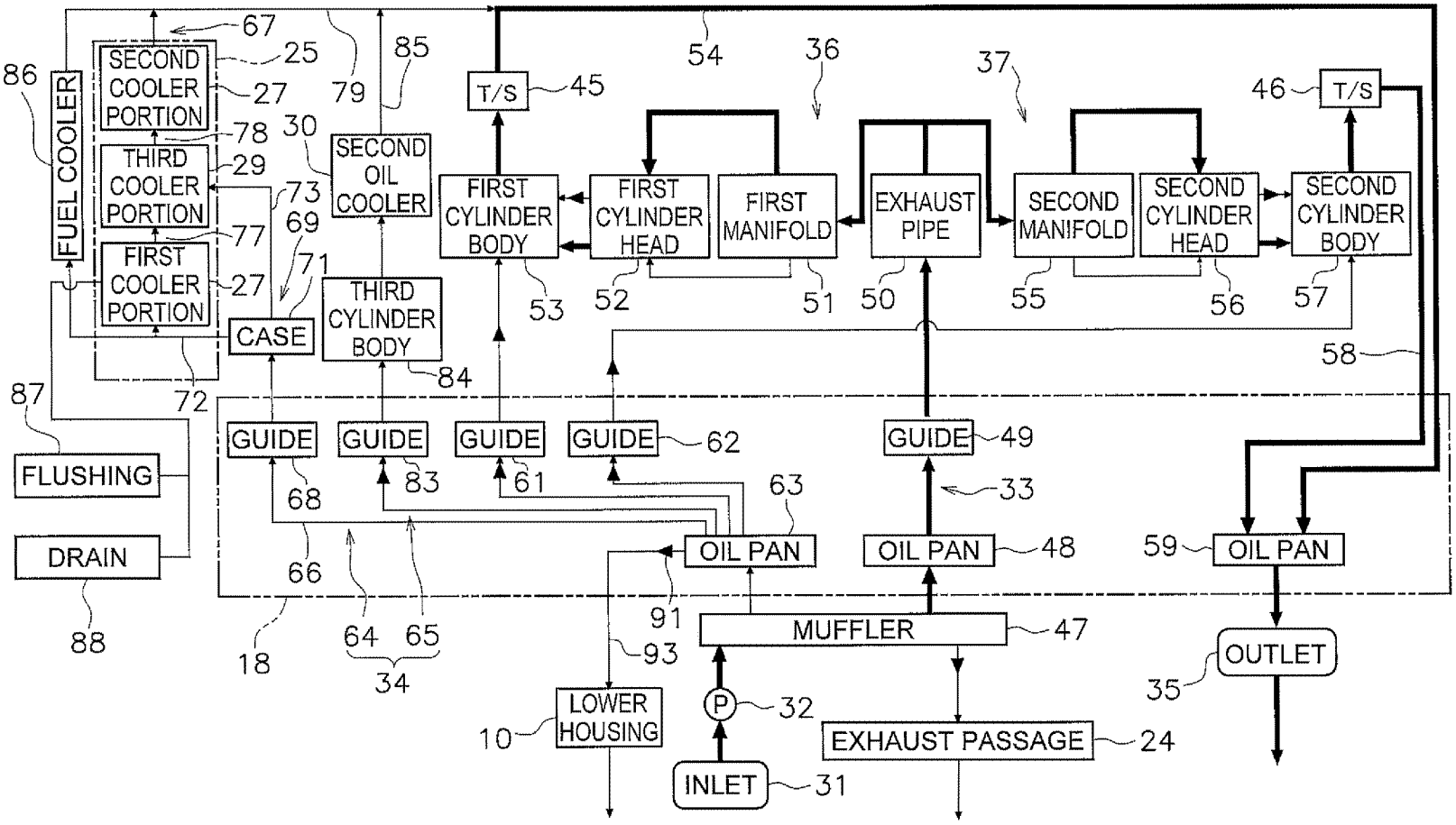
FIG. 3 is a block diagram showing a structure of a cooling water passage in the outboard motor.

FIG. 3 is a block diagram showing a structure of a cooling water passage in the outboard motor 1. As shown in FIG. 3, the cooling water passage in the outboard motor 1 includes an inlet 31, a water pump 32, an engine cooling water passage 33, an oil cooling water passage 34, and an outlet 35.

The inlet 31 is disposed in the lower housing 10. Water is taken into the cooling water passage from the outside of the outboard motor 1 through the inlet 31. The water pump 32 sucks the water through the inlet 31 and feeds the water to the engine cooling water passage 33 and the oil cooling water passage 34. The engine cooling water passage 33 is disposed inside the engine 2. The oil cooling water passage 34 is connected to the first oil cooler 25. The oil cooling water passage 34 branches from the engine cooling water passage 33.

Figure 4:
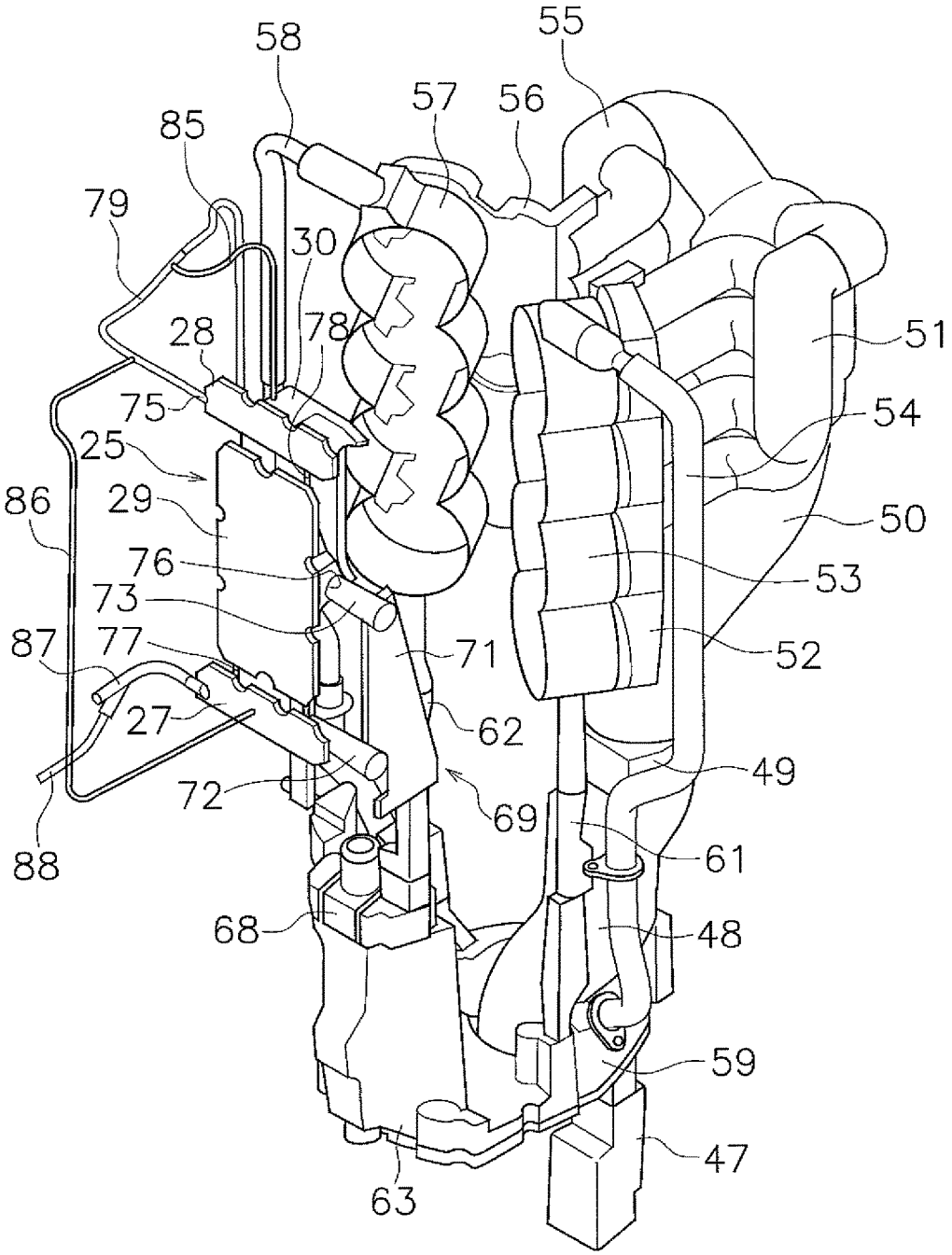
FIG. 4 is a perspective view of the cooling water passage in the outboard motor.
Figure 5:
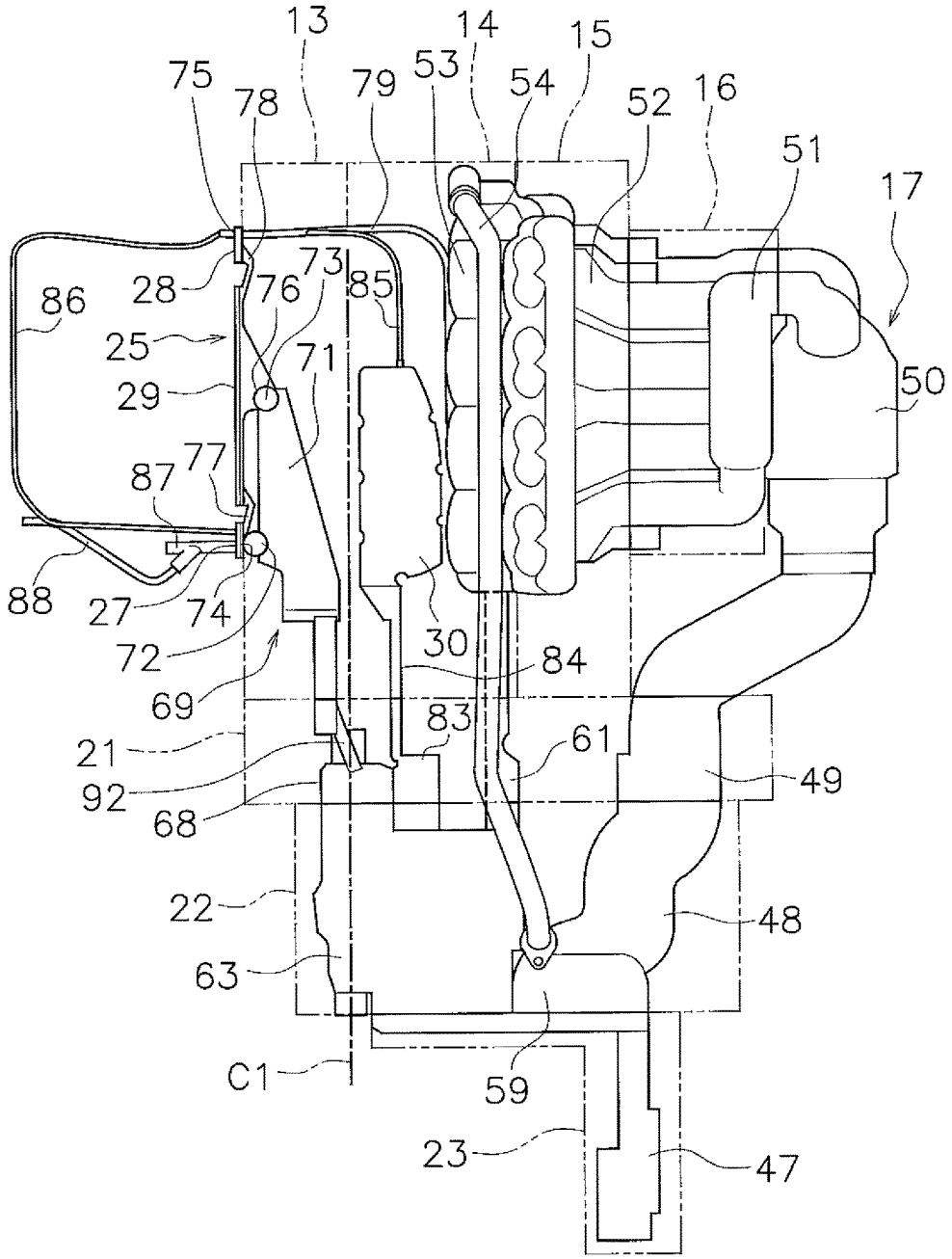
FIG. 5 is a side view of the cooling water passage in the outboard motor.

FIG. 4 is a perspective view of the cooling water passage in the outboard motor 1. FIG. 5 is a side view of the cooling water passage in the outboard motor 1. It should be noted that in FIG. 5, the dashed dotted line C1 indicates the center axis of the crankshaft 6. Additionally in FIG. 5, a dashed two-dotted line indicates the approximate positions of the crankcase 13, the cylinder body 14, the cylinder head 15, the exhaust guide 21, the oil pan 22, and the muffler 23.

As shown in FIGS. 4 and 5, the cooling water passage includes a muffler water passage 47. The muffler water passage 47 is disposed inside the muffler 23. As shown in FIG. 3, the muffler water passage 47 is connected to the inlet 31. The muffler water passage 47 is connected to the engine cooling water passage 33 and the oil cooling water passage 34.

The engine cooling water passage 33 includes a first oil pan water passage 48, a first guide water passage 49, and an exhaust pipe water passage 50. The first oil pan water passage 48 is disposed inside the oil pan 22. The first oil pan water passage 48 is connected to the muffler water passage 47. The first guide water passage 49 is disposed inside the exhaust guide 21. The first guide water passage 49 is connected to the first oil pan water passage 48. The exhaust pipe water passage 50 is disposed inside the exhaust pipe 17. The exhaust pipe water passage 50 is connected to the first guide water passage 49.

A first engine water passage 36 includes a first manifold water passage 51, a first cylinder head water passage 52, a first cylinder body water passage 53, and a first engine cooling pipe 54. The first manifold water passage 51 is disposed inside the exhaust manifold 16. The first cylinder head water passage 52 is disposed inside the cylinder head 15. The first cylinder head water passage 52 is connected to the first manifold water passage 51. The first cylinder body water passage 53 is disposed inside the cylinder body 14. The first cylinder body water passage 53 is connected to the first cylinder head water passage 52. A thermostat 45 is disposed downstream of the first cylinder body water passage 53.

The first engine cooling pipe 54 is disposed outside the engine 2. The first engine cooling pipe 54 is disposed inside the cowl 8. The first engine cooling pipe 54 extends in the up-and-down direction. The engine cooling water passage 33 includes a second oil pan water passage 59. The second oil pan water passage 59 is disposed inside the oil pan 22. The first engine cooling pipe 54 connects the first cylinder head water passage 52 and the second oil pan water passage 59.

A second engine water passage 37 includes a second manifold water passage 55, a second cylinder head water passage 56, a second cylinder body water passage 57, and a second engine cooling pipe 58. The second manifold water passage 55 is disposed inside the exhaust manifold 16. The second cylinder head water passage 56 is disposed inside the cylinder head 15. The second cylinder head water passage 56 is connected to the second manifold water passage 55. The second cylinder body water passage 57 is disposed inside the cylinder body 14. The second cylinder body water passage 57 is connected to the second cylinder head water passage 56. A thermostat 46 is disposed downstream of the second cylinder body water passage 57.

The second engine cooling pipe 58 is disposed outside the engine 2. The second engine cooling pipe 58 is disposed inside the cowl 8. The second engine cooling pipe 58 extends in the up-and-down direction. The second engine cooling pipe 58 connects the second cylinder head water passage 56 and the second oil pan water passage 59.

Water taken through the inlet 31 flows to the exhaust pipe water passage 50 through the muffler water passage 47, the first oil pan water passage 48, and the first guide water passage 49. The water flows upwardly in the muffler water passage 47, the first oil pan water passage 48, the first guide water passage 49, and the exhaust pipe water passage 50.

A portion of the water flows from the exhaust pipe water passage 50 to the second oil pan water passage 59 through the first manifold water passage 51, the first cylinder head water passage 52, the first cylinder body water passage 53, and the first engine cooling pipe 54. The water flows downwardly in the first engine cooling pipe 54.

On the other hand, another portion of the water flows from the exhaust pipe water passage 50 to the second oil pan water passage 59 through the second manifold water passage 55, the second cylinder head water passage 56, the second cylinder body water passage 57, and the second engine cooling pipe 58. The water flows downwardly in the second engine cooling pipe 58. The water merges in the second oil pan water passage 59 and is discharged through the outlet 35.

The oil cooling water passage 34 has a smaller cross-section in the flow passage than the engine cooling water passage 33. The oil cooling water passage 34 branches into a first oil water passage 64 and a second oil water passage 65.

The first oil water passage 64 includes a first cooling water passage 66 and a second cooling water passage 67. The first cooling water passage 66 is located upstream of the first oil cooler 25. The first cooling water passage 66 extends from the oil pan 22, passes through the exhaust guide 21 and the crankcase 13, and is connected to the first oil cooler 25. The second cooling water passage 67 is located downstream of the first oil cooler 25. The second cooling water passage 67 connects the first oil cooler 25 and the engine cooling water passage 33.

The first cooling water passage 66 includes a third oil pan water passage 63, a second guide water passage 68, and a case water passage 69. The third oil pan water passage 63 is disposed inside the oil pan 22. The second guide water passage 68 is disposed inside the exhaust guide 21. The second guide water passage 68 is connected to the third oil pan water passage 63.

The third oil pan water passage 63, the second guide water passage 68, and the case water passage 69 are disposed below the first oil cooler 25. A portion of the third oil pan water passage 63 is located forward of a center axis C1 of the crankshaft 6. A portion of the second guide water passage 68 is located forward of the center axis C1 of the crankshaft 6. The case water passage 69 is located forward of the center axis C1 of the crankshaft 6.

The case water passage 69 is disposed inside the crankcase 13. The case water passage 69 is connected to the second guide water passage 68. As shown in FIGS. 4 and 5, the case water passage 69 includes a body water passage 71, a first connecting water passage 72, and a second connecting water passage 73. The body water passage 71 is connected to the second guide water passage 68. The body water passage 71 extends upwardly from the second guide water passage 68.

The first connecting water passage 72 is connected to the body water passage 71. The first connecting water passage 72 extends from the body water passage 71 in the right-and-left direction. The first connecting water passage 72 connects the body water passage 71 and the first cooler portion 27. As shown in FIG. 5, the first cooler portion 27 includes a first connection port 74. The first connecting water passage 72 is connected to the first connection port 74.

The second connecting water passage 73 is connected to the body water passage 71. The second connecting water passage 73 extends from the body water passage 71 in the right-and-left direction. The second connecting water passage 73 is located higher than the first connecting water passage 72. The second connecting water passage 73 connects the body water passage 71 and the third cooler portion 29. The third cooler portion 29 includes a third connection port 76. The third connection port 76 is located higher than the first connection port 74. The second connecting water passage 73 is connected to the third connection port 76.

The first cooler portion 27 and the third cooler portion 29 are connected through a first coupling water passage 77. The first coupling water passage 77 extends upwardly from the first cooler portion 27 toward the third cooler portion 29. The third cooler portion 29 and the second cooler portion 28 are connected through a second coupling water passage 78. The second coupling water passage 78 extends upwardly from the third cooler portion 29 toward the second cooler portion 28.

The second cooling water passage 67 includes a first oil cooling pipe 79. The first oil cooling pipe 79 is disposed outside the engine 2. The first oil cooling pipe 79 is disposed inside the cowl 8. The first oil cooling pipe 79 is connected to the first oil cooler 25. The second cooler portion 28 includes a second connection port 75. The second connection port 75 is located higher than the first connection port 74 and the third connection port 76. The first oil cooling pipe 79 is connected to the second cooler portion 28.

The first oil cooling pipe 79 extends sideways from the second cooler portion 28 and then bends backward. Additionally, the first oil cooling pipe 79 bends downward, and then extends downwards and through a lateral side of the engine 2. The first oil cooling pipe 79 is connected to the first engine cooling pipe 54.

The water taken in through the inlet 31 flows to the first oil cooler 25 through the muffler water passage 47, the third oil pan water passage 63, the second guide water passage 68, and the case water passage 69. The water flows upwardly in the muffler water passage 47, the third oil pan water passage 63, the second guide water passage 68, and the case water passage 69.

In the case water passage 69, a portion of the water flows from the first connecting water passage 72 to the third cooler portion 29 through the first cooler portion 27 and the first coupling water passage 77. In the case water passage 69, another portion of the water flows from the second connecting water passage 73 to the third cooler portion 29. The water merges in the third cooler portion 29 and flows to the first oil cooling pipe 79 through the second coupling water passage 78 and the second cooler portion 28. The water flows upwardly in the first cooler portion 27, the first coupling water passage 77, the third cooler portion 29, the second coupling water passage 78, and the second cooler portion 28.

As described above, the water, which has flowed through the first oil cooler 25, flows from the first oil cooling pipe 79 to the first engine cooling pipe 54, and is discharged through the outlet 35 together with the water that has cooled the engine 2 as described above.

The outboard motor 1 preferably includes a second oil cooler 30. The second oil cooler 30 is disposed inside the cylinder body 14. The second oil water passage 65 is connected to the first oil water passage 64. The second oil water passage 65 is connected to the first oil water passage 64 in a downstream portion of the first oil cooler 25.

The second oil water passage 65 includes a third guide water passage 83, a third cylinder body water passage 84, and a second oil cooling pipe 85. The third guide water passage 83 is disposed inside the exhaust guide 21. The third guide water passage 83 is connected to the third oil pan water passage 63. The third guide water passage 83 extends upwardly from the third oil pan water passage 63.

The third cylinder body water passage 84 is disposed inside the cylinder body 14. The third cylinder body water passage 84 is connected to the third guide water passage 83. The third cylinder body water passage 84 extends upwardly from the third guide water passage 83. The third cylinder body water passage 84 is connected to a bottom portion of the second oil cooler 30.

The second oil cooling pipe 85 is connected to a top portion of the second oil cooler 30. The second oil cooling pipe 85 extends upwardly from the second oil cooler 30 and bends sideways. The second oil cooling pipe 85 is connected to the first oil cooling pipe 79.

The water taken in through the inlet 31 flows to the second oil cooler 30 through the muffler water passage 47, the third oil pan water passage 63, and the third guide water passage 83. The water flows upwardly in the muffler water passage 47, the third oil pan water passage 63, the third guide water passage 83, and the second oil cooler 30.

As described above, the water, which has flowed through the second oil cooler 30, flows from the second oil cooling pipe 85 to the first engine cooling pipe 54 through the first oil cooling pipe 79, and is discharged through the outlet 35 together with the water that has cooled the engine 2 as described above.

It should be noted that the cooling water passage includes a fourth guide water passage 61 and a fifth guide water passage 62. The fourth guide water passage 61 and the fifth guide water passage 62 are disposed inside the exhaust guide 21. The fourth guide water passage 61 is connected to the third oil pan water passage 63. The fourth guide water passage 61 extends upwardly from the third oil pan water passage 63. The fourth guide water passage 61 is connected to the first cylinder body water passage 53.

The fifth guide water passage 62 is connected to the third oil pan water passage 63. The fifth guide water passage 62 extends upwardly from the third oil pan water passage 63. The fifth guide water passage 62 is connected to the second cylinder body water passage 57.

Inside the oil pan 22, the first, second and third oil pan water passages 48, 59 and 63 are preferably integral with the oil pan 22. Inside the exhaust guide 21, the first, second, third, fourth and fifth guide water passages 49, 68, 83, 61 and 62 are preferably integral with the exhaust guide 21. Inside the crankcase 13, the case water passage 69 is preferably integral with the crankcase 13.

A fuel cooler 86 is connected to the case water passage 69. The fuel cooler 86 is disposed on a fuel tank (not shown in the drawings). The fuel cooler 86 extends in the up-and-down direction. The fuel cooler 86 is connected to the first oil cooling pipe 79. A portion of the water inside the case water passage 69 flows upwardly through the fuel cooler 86. The portion of the water flows from the fuel cooler 86 to the first oil cooling pipe 79 and merges with the water that has flowed through the first oil cooler 25.

The cooling water passage preferably includes a flushing water passage 87 and a drain water passage 88. The flushing water passage 87 and the drain water passage 88 are connected to the first cooler portion 27. When cleaning the cooling water passage, water is supplied to the flushing water passage 87. The water supplied to the flushing water passage 87 flows through the cooling water passage in the outboard motor 1, thus the cooling water passage is cleaned. After cleaning the cooling water passage, the water is discharged through the drain water passage 88.

Figure 6:
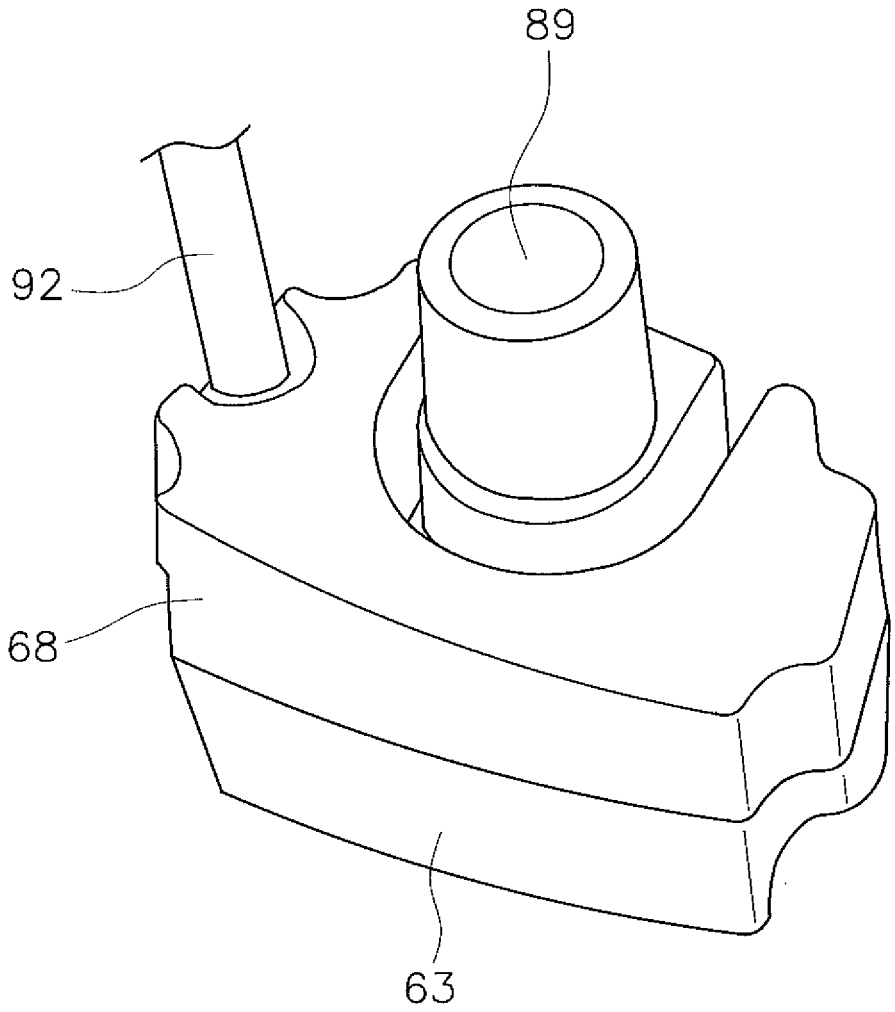
FIG. 6 is a perspective view of a portion of a third oil pan water passage and a second guide water passage.
Figure 7:
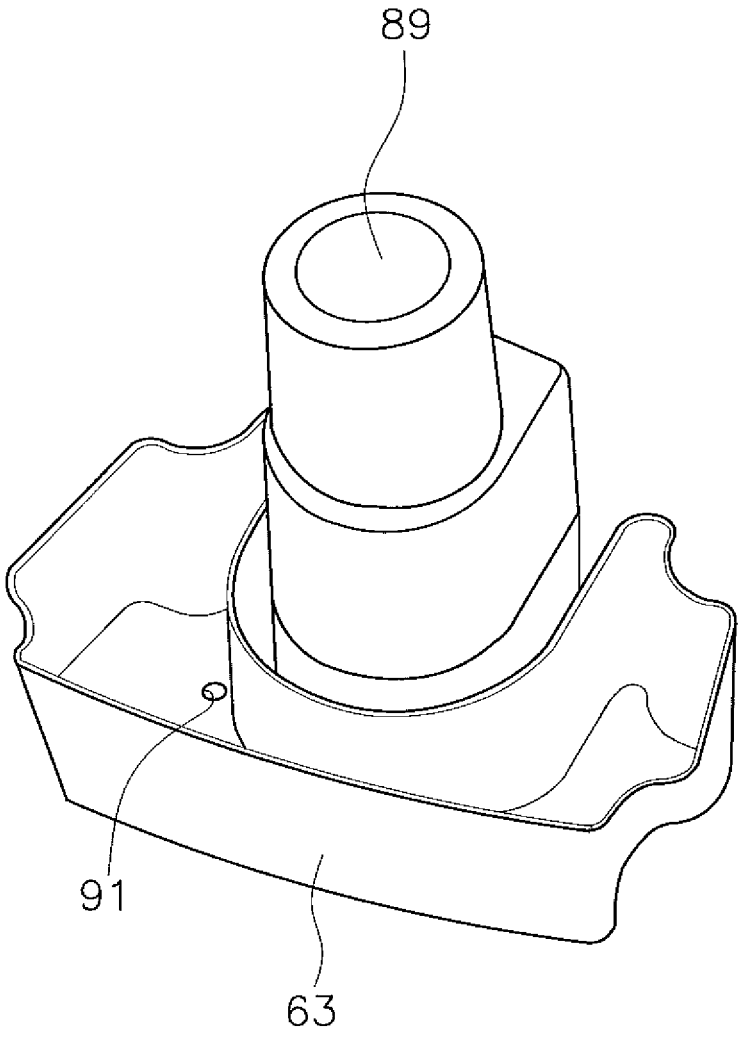
FIG. 7 is a perspective view of a portion of the third oil pan water passage.

FIG. 6 is a perspective view of a portion of the third oil pan water passage 63 and the second guide water passage 68. FIG. 7 is a perspective view of a portion of the third oil pan water passage 63. As shown in FIG. 6, the oil pan 22 and the exhaust guide 21 include a hole 89 into which the crankshaft 6 is inserted. The third oil pan water passage 63 and the second guide water passage 68 surround the hole 89.

As shown in FIG. 7, the oil pan 22 includes a water discharge hole 91. The water discharge hole 91 communicates with the third oil pan water passage 63. The water discharge hole 91 extends downwardly through the interior of the oil pan 22. The water discharge hole 91 communicates with the interior of the lower housing 10 through the interior of the upper housing 9.

The opening area of the water discharge hole 91 is smaller than the cross-sectional flow area of the third oil pan water passage 63. As shown in FIG. 6, the second guide water passage 68 includes a connecting water passage 92. The connecting water passage 92 is connected to the case water passage 69. The opening area of the water discharge hole 91 is smaller than the cross-sectional flow area of the connecting water passage 92.

As shown in FIG. 3, the cooling water passage includes a water discharge passage 93. The water discharge passage 93 includes the case water passage 69, the second guide water passage 68, the third oil pan water passage 63, and the water discharge hole 91. Therefore, the water discharge passage 93 includes a portion of the first cooling water passage 66, in other words, the case water passage 69, the second guide water passage 68, and the third oil pan water passage 63. Put differently, the water discharge passage 93 is connected to the first oil cooler 25 through the first cooling water passage 66. A portion of the water discharge passage 93 is disposed lower than the first oil cooler 25 and forward of the center axis C1 of the crankshaft 6.

When deactivating the engine 2, the water inside the first oil cooler 25 is discharged to the outside of the outboard motor 1 through the water discharge passage 93. In detail, the water inside the first oil cooler 25 flows into the upper housing 9 through the case water passage 69, the second guide water passage 68, the third oil pan water passage 63, and the water discharge hole 91. The water inside the upper housing 9 flows through the interior of the lower housing 10 and is discharged therefrom to the outside.

Therefore, the case water passage 69, the second guide water passage 68, and the third oil pan water passage 63 define a portion of the first cooling water passage 66 when activating the engine 2, but on the other hand, define a portion of the water discharge passage 93 when deactivating the engine 2.

Figure 8:
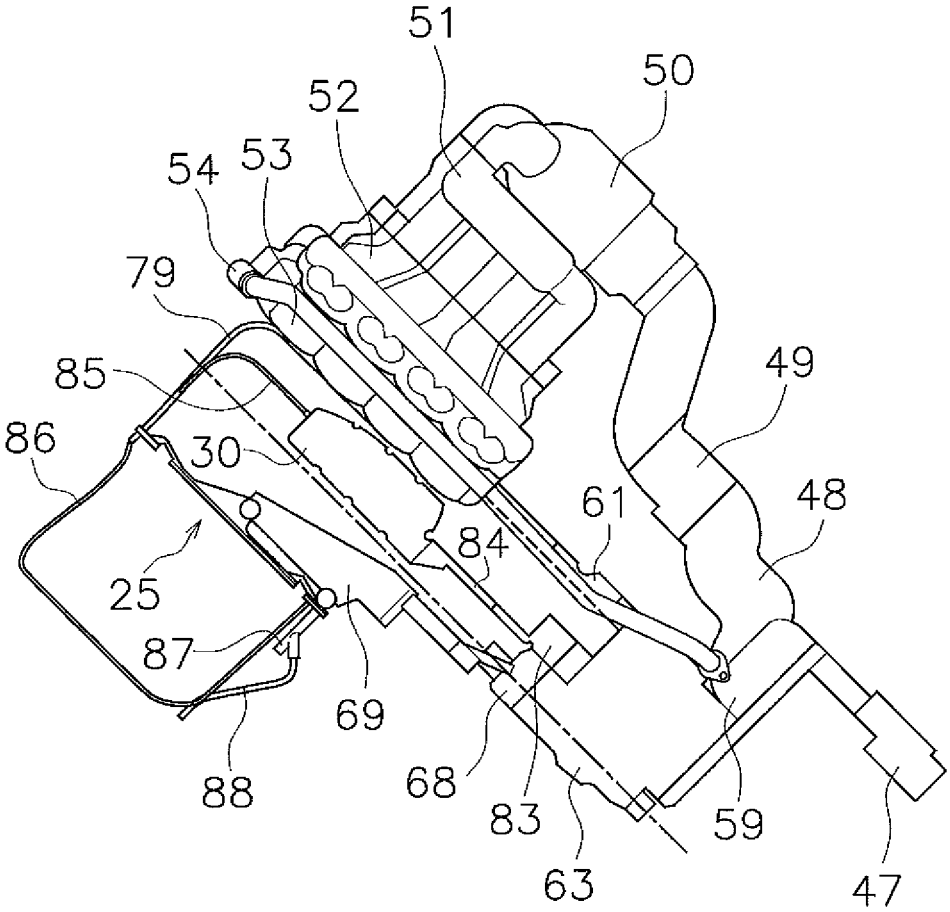
FIG. 8 is a diagram showing the outboard motor in a tilted-up position.

FIG. 8 shows the outboard motor 1 in a tilted-up position. In the outboard motor 1 according to the present preferred embodiment, the water discharge passage 93 is disposed lower than the first oil cooler 25 and forward of the center axis C1 of the crankshaft 6. Therefore, as shown in FIG. 8, even when the engine 2 is deactivated and the outboard motor 1 is in the tilted-up position, water discharge from the first oil cooler 25 is enhanced.

Preferred embodiments of the present invention have been explained above. However, the present invention is not limited to the above described preferred embodiments, and a variety of changes can be made without departing from the gist of the present invention.

The layout of the cooling water passage may be changed. The layout of the engine cooling water passage 33 may be changed. For example, the engine cooling water passage 33, designed to pass through the exhaust pipe 17, the exhaust manifold 16, the cylinder head 15 and the cylinder body 14, may pass therethrough in a different order.

The layout of the first oil water passage 64 may be changed. For example, the first oil water passage 64 may not be provided with any of the case water passage 69, the second guide water passage 68, and the third oil pan water passage 63. The shapes of the case water passage 69, the second guide water passage 68, and the third oil pan water passage 63 may be changed. A portion of the first oil water passage 64 may include a pipe or a hose.

The layout of the second oil water passage 65 may be changed. A portion of the second oil water passage 65 may include a pipe or a hose. Alternatively, the second oil water passage 65 may not be provided.

The water discharge passage 93 may be provided independently from the first cooling water passage 66. The water discharge passage 93 may not be provided with any of the case water passage 69, the second guide water passage 68, and the third oil pan water passage 63. A portion of the water discharge passage 93 may include a pipe or a hose.

The water discharge hole 91 may be disposed in an element other than the oil pan 22. For example, the water discharge hole 91 may be disposed in the exhaust guide 21. The water discharge hole 91 may communicate with an element other than the interior of the lower housing 10. For example, the water discharge hole 91 may be connected to the outlet 35 provided in the upper housing 9.

The structure of the first oil cooler 25 may be changed. For example, any of the first, second and third cooler portions 27 to 29 may not be provided. The first, second and third cooler portions 27 to 29 may be integral with each other. The structure of the second oil cooler 30 may be changed. Alternatively, the second oil cooler 30 may not be provided.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:

an engine including a crankshaft;

a drive shaft connected to the crankshaft, the drive shaft extending downwardly from the engine;

a propeller shaft connected to the drive shaft, the propeller shaft extending in a direction intersecting with the drive shaft;

an oil cooler disposed forward of the crankshaft;

an engine cooling water passage disposed inside the engine;

an oil cooling water passage connected to the oil cooler, the oil cooling water passage branching from the engine cooling water passage; and a water discharge passage connected to the oil cooler and being disposed lower than the oil cooler and forward of a center axis of the crankshaft; wherein the engine includes a crankcase; and at least one portion of the water discharge passage is located inside the crankcase.

2. The outboard motor according to claim 1, wherein the oil cooling water passage includes:

a first cooling water passage located upstream of the oil cooler; and a second cooling water passage located downstream of the oil cooler; and the first cooling water passage is located directly below the oil cooler.

3. The outboard motor according to claim 2, wherein the first cooling water passage extends downwardly from the oil cooler.

4. The outboard motor according to claim 2, wherein the oil cooler includes:

a first connection port connected to the first cooling water passage; and a second connection port connected to the second cooling water passage; and the second connection port is located higher than the first connection port.

5. The outboard motor according to claim 4, wherein the oil cooler extends upwardly from the first connection port to the second connection port.

6. The outboard motor according to claim 2, further comprising:

a support disposed below the engine, the support supporting the engine; wherein at least one portion of the first cooling water passage is located inside the support.

7. The outboard motor according to claim 6, wherein the at least one portion of the first cooling water passage is integral with the support.

8. The outboard motor according to claim 2, wherein the water discharge passage is connected to the oil cooler through the first cooling water passage.

9. The outboard motor according to claim 8, wherein the water discharge passage includes a water discharge hole in communication with the first cooling water passage; and the water discharge hole includes an opening area smaller than a cross-sectional flow area of the first cooling water passage.

10. The outboard motor according to claim 1, further comprising:

a support disposed below the engine, the support supporting the engine; wherein at least one portion of the water discharge passage is located inside the support.

11. The outboard motor according to claim 10, wherein the at least one portion of the water discharge passage is integral with the support.

12. The outboard motor according to claim 1, wherein the at least one portion of the water discharge passage is integral with the crankcase.

13. The outboard motor according to claim 1, further comprising: an electric component attached to the oil cooler.

* * * * *